US007963670B2

(12) United States Patent
Yu

(10) Patent No.: US 7,963,670 B2
(45) Date of Patent: Jun. 21, 2011

(54) BYPASS COMPONENTS IN SERIES WIRED LED LIGHT STRINGS

(75) Inventor: Jingjing Yu, El Monte, CA (US)

(73) Assignee: 1 Energy Solutions, Inc., El Monte, CA (US)

( * ) Notice: Subject to any disclaimer, the term of this patent is extended or adjusted under 35 U.S.C. 154(b) by 915 days.

(21) Appl. No.: 11/831,929

(22) Filed: Jul. 31, 2007

(65) Prior Publication Data

US 2008/0024071 A1 Jan. 31, 2008

Related U.S. Application Data

(63) Continuation-in-part of application No. 11/461,293, filed on Jul. 31, 2006, now abandoned.

(51) Int. Cl.
*F21S 4/00* (2006.01)
*F21V 21/00* (2006.01)

(52) U.S. Cl. ..... 362/249.02; 362/652; 362/653; 362/654; 362/655; 362/656; 362/657; 362/658; 362/659; 362/800

(58) Field of Classification Search ..... 362/652–659, 362/249, 800, 249.02
See application file for complete search history.

(56) References Cited

U.S. PATENT DOCUMENTS

| | | | |
|---|---|---|---|
| 3,758,771 | A | 9/1973 | Frohardt |
| 4,223,248 | A | 9/1980 | Tong |
| 4,298,869 | A | 11/1981 | Okuno |
| 4,316,125 | A | 2/1982 | Noguchi |
| 4,321,598 | A | 3/1982 | Warner |
| 4,329,625 | A | 5/1982 | Nishizawa |
| 4,365,244 | A | 12/1982 | Gillessen |
| 4,367,471 | A | 1/1983 | Gillessen |
| 4,396,823 | A | 8/1983 | Nihei |
| 4,521,835 | A | 6/1985 | Meggs |
| 4,595,920 | A | 6/1986 | Runyan |
| 4,652,981 | A | 3/1987 | Glynn |
| 4,675,575 | A | 6/1987 | Smith |
| 4,727,603 | A | 3/1988 | Howard |
| 4,839,777 | A | 6/1989 | Janko |
| 4,843,280 | A | 6/1989 | Lumbard |
| 4,857,920 | A | 8/1989 | Kataoka |

(Continued)

FOREIGN PATENT DOCUMENTS

| | | |
|---|---|---|
| CA | 2342321 | 3/2000 |

OTHER PUBLICATIONS www.optics.org, The Online Photonics Resource.

(Continued)

*Primary Examiner* — Sharon E Payne
*Assistant Examiner* — William J Carter
(74) *Attorney, Agent, or Firm* — William W. Cochran; Cochran Freund & Young LLC

(57) ABSTRACT

Disclosed is an LED light string that uses parallel connected bypass components that are connected across the leads of the LEDs and are disposed in the socket of the LED lamp holder. The use of parallel connected bypass components across the leads of the LEDs greatly enhances the reliability of the light string. Bypass components are also included in the LED lamp structure, both internally to the LED lamp proxy and externally across the leads of the LED lamp element. A resistive wire can also be connected between conductors in an LED socket structure inside a lamp holder. Using the bypass components, twinkle lamps can be inserted in series wired LED light strings.

10 Claims, 11 Drawing Sheets

U.S. PATENT DOCUMENTS

| | | | | |
|---|---|---|---|---|
| 4,954,822 | A | 9/1990 | Borenstein | |
| 4,959,766 | A | 9/1990 | Jain | |
| 5,087,212 | A | 2/1992 | Hanami | |
| 5,130,897 | A | 7/1992 | Kuzma | |
| 5,155,669 | A | 10/1992 | Yamuro | |
| 5,187,377 | A | 2/1993 | Katoh | |
| 5,193,895 | A | 3/1993 | Naruke | |
| 5,257,020 | A | 10/1993 | Morse | |
| 5,313,187 | A | 5/1994 | Choi | |
| 5,323,305 | A | 6/1994 | Ikeda | |
| 5,366,780 | A | 11/1994 | Rapisarda | |
| 5,404,282 | A | 4/1995 | Klinke | |
| 5,410,458 | A | 4/1995 | Bell | |
| 5,436,809 | A | 7/1995 | Brassier | |
| 5,457,450 | A | 10/1995 | Deese | |
| 5,463,280 | A | 10/1995 | Johnson | |
| 5,528,484 | A | 6/1996 | Hayashi | |
| 5,567,037 | A | 10/1996 | Ferber | |
| 5,649,755 | A | 7/1997 | Rapisarda | |
| 5,663,719 | A | 9/1997 | Deese | |
| 5,726,535 | A | 3/1998 | Yan | |
| 5,762,419 | A | 6/1998 | Yam | |
| 5,808,592 | A | 9/1998 | Mizutani | |
| 5,887,967 | A | 3/1999 | Chang | |
| 5,936,599 | A | 8/1999 | Raymond | |
| 5,941,626 | A | 8/1999 | Yamuro | |
| 5,962,971 | A | 10/1999 | Chen | |
| 5,988,831 | A | 11/1999 | Pan | |
| 6,072,280 | A | 6/2000 | Allen | |
| 6,183,310 | B1 | 2/2001 | Shu | |
| 6,190,021 | B1 | 2/2001 | Huang | |
| 6,200,003 | B1 | 3/2001 | Tseng | |
| 6,283,797 | B1 * | 9/2001 | Wu | 439/699.2 |
| 6,361,198 | B1 | 3/2002 | Reed | |
| 6,461,019 | B1 * | 10/2002 | Allen | 362/249.06 |
| 6,505,954 | B2 | 1/2003 | Chen | |
| 6,830,358 | B2 | 12/2004 | Allen | |
| 7,012,379 | B1 * | 3/2006 | Chambers et al. | 362/800 |
| 7,045,965 | B2 | 5/2006 | Li et al. | |
| 2002/0043943 | A1 * | 4/2002 | Menzer et al. | 315/291 |

OTHER PUBLICATIONS http://ledmuseum.home.att.net/xmas1.htm;www.foreverbright.com.
Christmas may be brighter longer, Huntsville Times, Huntsville, Alabama, Dec. 10, 2001.
"Holiday lights that stay ready for action," News Journal, Wilmington Metropolitan Area, Dec. 17, 2001.
"Bulbs that didn't work spur new line of lights," Richmond, Virginia, Times, Dec. 25, 2001.
"Now, let's eliminate tangles too," Sentinel-Tribune, Bowling Green, Ohio, Dec. 22, 2001.
"LED Christmas lights gaining in popularity," Luce Press, Shamokin, Pennsylvania, Dec. 2, 2001.
"It's beginning to look a lot light Christmas," Luce Press, Democrat, Tallahassee, Florida, Dec. 3, 2001.
"LED lights are Christmas option," Luce Press, Herald News, Joliet, Illinois, Nov. 28, 2001.
Long-lasting LED Christmas lights gaining in popularity, Luce Press, Capital, Annapolis, Maryland, Dec. 2, 2001.
"A welcome idea for those who string holiday lights," Luce Press, Times, Seattle, Washington, Nov. 29, 2001.
"LED Christmas lights gaining in popularity," Luce Press, Reporter, Vacaville, California, Nov. 28, 2001.
"LEDing the way," Luce Press, Chronicle, Houston, Texas, Dec. 2, 2001.
". . . malfunctioning yule lights," Desert News, Salt Lake City-Ogden Metro Area, Utah, Dec. 9, 2001.
"LED holiday lights catch on," Luce Press, Herald, Sharon, Pennsylvania, Dec. 2, 2001.
"LED Christmas lights gain popularity," Luce Press, Local News, West Chester, Pennsylvania, Nov. 24, 2001.
"A brighter day for yule lights," Luce Press, Star, Kansas City, Missouri, Dec. 8, 2001.
"LED Lights Giving Off a Christmas Sparkle," "Entrepreneurs Claim LED Technology Better Than Christmas Bulbs," Luce Press, Tribune, Salt Lake City-Ogden, Utah, Dec. 2, 2001.
"New Christmas lights gaining popularity," Luce Press, Intelligencer, Doylestown, Pennsylvania, Nov. 28, 2001.
"Forever Bright," Luce Press, New Jersey Herald, Newton, New Jersey, Nov. 25, 2001.
"Replacements for traditional Christmas lights gaining popularity," Luce Press, Nov. 28, 2001.
"Inventor lights up Christmas," Luce Press, Valley News Dispatch, Tarentum, Pennsylvania, Nov. 25, 2001.
"LED Christmas Lights Gaining Popularity," Luce Press, Times, Nov. 25, 2001.
"LED Christmas lights gaining popularity," Luce Press, Beaver County Times, Beaver, Pennsylvania, Nov. 25, 2001.
"The Christmas light man," Luce Press, Dominion Post, Morgantown, West Virginia, Nov. 24, 2001.
"Forever bright, More-efficient LED holiday lights gain popularity," Luce Press, Dispatch, York, Pennsylvania, Dec. 3, 2001.
"A bright idea leads to LED lights," Luce Press, Vindicator, Youngstown, Ohio, Nov. 30, 2001.
"Bright Idea, LED Lights Gaining in Popularity," Sun-Gazette, Williamsport, Pennsylvania, Nov. 26, 2001.
"LED lights brighten holiday," Luce Press, Record, York, Pennsylvania, Nov. 26, 2001.
"LEDs the coolest thing in holiday lights," Luce Press, Press, Atlantic City, New Jersey, Nov. 25, 2001.
"Consumers switch to LED Christmas lights for their reliability," Luce Press, Star-Gazette, Elmira, New York, Dec. 2, 2001.
"All wrapped up," Luce Press, Ledger, Ellwood City, Pennsylvania, Dec. 1, 2001.
"LED Christmas lights gain popularity with customers," Luce Press, News, Jacksonville, North Carolina, Dec. 4, 2001.
"Innovative LED Christmas lights gaining popularity," Luce Press, Pantagraph, Bloomington, Illinois, Dec. 3, 2001.
"Beating Christmas burnout," Luce Press, Press Enterprise, Bloomsburg, Pennsylvania, Nov. 26, 2001.
"LED Christmas lights gain popularity," Luce Press, Advertiser, Montgomery, Alabama, Dec. 2, 2001.
"Forever bright LED Christmas lights gaining popularity," Luce Press, Capital Times, Madison, Wisconsin, Nov. 27, 2001.
"A new twist on Christmas lights," Luce Press, News-Sentinel, Tennessee, Nov. 29, 2001.
"LED Christmas Lights Gaining in Popularity," Luce Press, Bulletin, Latrobe, Pennsylvania, Nov. 28, 2001.
"Forever bright LED holiday lights gaining popularity," Luce Press, News, New Castle, Pennsylvania, Nov. 26, 2001.
"LED Christmas lights becoming popular," Luce Press Clippings, State Journal, Lansing, Michigan, Nov. 28, 2001.
"Holiday Lighting: Latest Technology Saves Time, Money and More," North American Clipping Bureau, Holly Hill Observer, Bamberg, South Carolina, Dec. 5, 2001.
"Holiday lighting: latest technology saves time, money and more," North American Clipping Bureau, Independent-Register, Broadhead, Wisconsin, Nov. 28, 2001.
"Holiday lighting: Latest Technology Saves Time, Money and More," Burelle's, Foothills Trader, New Hartford, Connecticut, Dec. 17, 2001.
"Holiday Lighting: Latest Technology Saves Time, Money and More," Burelle's, Guide News, Mechanicsburg, Pennsylvania, Dec. 12, 2001.
"Holiday Lighting: Latest Technology Saves Time, Money and More," North American Clipping Bureau, Hickory Hill Reporter, Palos Heights, Illinois, Dec. 13, 2001.
"Latest lighting technology saves time, money and more," Luce Press Clippings, Herald, Bourbonnais, Illinois, Dec. 11, 2001.
"Holiday Lighting: Latest Technology Saves Time, Money and More," Luce Press Clippings, Upper Darby Press, Drexel Hill, Pennsylvania, Nov. 29, 2001.
"Holiday Lighting: Latest Technology Saves Time, Money and More," North American Clipping Bureau, Fillmore Herald, Fillmore, California, Dec. 6, 2001.

"Holiday Lighting: Latest Technology Saves Time, Money and More," North American Clipping Bureau, Manila Mail, Daly City, California, Dec. 19, 2001.
"Holiday Lighting: Latest Technology Saves Time, Money and More," Burrelle's, Yeadon Times, Yeadon, Pennsylvania, Nov. 29, 2001.
"Holiday Lighting: Latest Technology Saves Time, Money and More," Shopper's Review, Marshall, Minnesota, Nov. 28, 2001.
"Holiday Lighting: Latest Technology Saves Time, Money and More," North American Clipping Bureau, Sunrise Edition, Dayton, Tennessee, Dec. 16, 2001.
"Holiday Lighting: Latest Technology Saves Time, Money and More," Desert Valley Times, Mesquite, Nevada, Dec. 6, 2001.
"Holiday Lighting: Latest Technology Saves Time, Money and More," North American Clipping Breau, Worth-Ridge Reporter, Palos Heights, Illinois, Dec. 13, 2001.
"Holiday Lighting: Latest Technology Saves Time, Money and More," North American Clipping Bureau, Oaklawn-Evergreen Park Reporter, Palos Heights, Illinois, Dec. 13, 2001.
"Holiday Lighting: Latest Technology Saves Time, Money and More," North American Clipping Bureau, Regional News, Palos Heights, Illinois, Dec. 13, 2001.
"Holiday Lighting: Latest Technology Saves Time, Money and More," Burelle's, Ridley Press, Folson, Pennsylvania, Nov. 29, 2001.
"Holiday Lighting: Latest Technology Saves Time, Money and More," Burelle's, Claymont News, Drexel Hill, Pennsylvania, Nov. 29, 2001.
"Holiday Lighting: Latest Technology Saves Time, Money and More," North American Clipping Bureau, Auction & Real Estate News, Cissna Park, Illinois, Nov. 29, 2001.
"Holiday Lighting: Latest Technology Saves Time, Money and More," North American Clipping Bureau, Home News & Times, Yonkers, New York, Nov. 22, 2001.
"Holiday Lighting: Latest Technology Saves Time, Money and More," Luce Press Clippings, Calvert Reporter, Prince Frederick, Maryland, Nov. 21, 2001.
"Holiday Lighting: Latest Technology Saves Time, Money and More," North American Clipping Bureau, Marcus Hook Press, Drexel Hill, Pennsylvania, Nov. 29, 2001.
"Holiday Lighting: Latest Technology Saves Time, Money and More," . . . Pointe News, Michigan, Nov. 22, 2001.
"Holiday Lighting: Latest Technology Saves Time, Money and More," Luce Press Clippings, Independent-Register, Brodhead, Wisconsin, Nov. 28, 2001.
"New kind of Christmas lights cut electricity use." Luce Press Clippings, Nevada Appeal, Carson City, Nevada, Dec. 2, 2001.
"Lights a big part of Christmas," Luce Press Clippings, Pope County Tribune, Glenwood, Minnesota, Dec. 24, 2001.
Article, Plaquemines Watchma . . . , Belle Chasse, LA, Nov. 27, 2001; Journal Herald, Greensboro, GA, Nov. 30, 2001; Weekly Mail Journal, Chardon, OH, Dec. 5, 2001; Greenup Press, Greenup, IL, Dec. 20, 2001; News-Reporter, Washington, GA, Dec. 20, 2001; West Bend Journal, West Bend, IA, Nov. 29, 2001; Abbeville Herald, Abbeville, AL, Nov. 29, 2001; Observer Weekly New . . . , Hasbrouck Height, NJ, Nov. 22, 2001; Health City Sun, Albuquerque, NM, Dec. 21, 2001; Sun-News, Lowden, IA, Nov. 29, 2001; Hebron.
"Holiday Lighting: Latest Technology Saves Time, Money and More," North American Clipping Bureau, Hi-Rise Expressions, Montclair, New Jersey, Nov. 1, 2001.
"Holiday Lighting: Latest Technology Saves Time, Money and More," North American Clipping Bureau, Weekly Mail Journal, Chardon, Ohio, Dec. 12, 2001.
"Holiday Lighting: Latest Technology Saves Time," North American Clipping Bureau, Valley Herald, Spokane, Washington, Oct. 24, 2001.
"Holiday Lighting: latest technology saves time, money and more," Broadhead, The Independent Register, Madison, Wisconsin, Nov. 28, 2001.
"Holiday Lighting: Latest Technology Saves Time, Money and More," Clinton County News, New Baden, Illinois, Nov. 29, 2001.
"Holiday lighting," Cedar Lake Lowell Star, Nov. 2001.
"Holiday lighting," Crown Point Star, Nov. 22, 2001.
"Latest technology saves money and time," Luce Press Clippings, News, Grosse Points, Michigan, Nov. 22, 2001.
"Holiday lighting: latest technology saves time," Luce Press Clippings, Journal, Friendswood, Texas, Nov. 21, 2001.
"Holiday Lighting: Latest Technology Saves Time, Money and More," North American Clipping Bureau, Home News & Times, Yonkers, New York, Nov. 22, 2001.
"Holiday Lighting: Latest Technology Saves Time, Money and More," North American Clipping Bureau, Fort Bend Star, Stafford, Texas, Nov. 21, 2001.
"Holiday lighting," Luce Press Clippings, Crown Point Star, Chicago Metro Area, Nov. 22, 2001.
Holiday lighting, latest technology saves time, Luce Press Clippings, Journal, Pearland, Texas, Nov. 21, 2001.
"Holiday lighting," North American Clipping Bureau, Redlands Daily Facts, Redlands, California, Nov. 22, 2001.
"Holiday Lighting: Latest Technology Saves Time, Money and More," North American Clipping Bureau, Wyoming, Dec. 3, 2001.
"Latest lighting technology saves time, money and more," North American Clipping Bureau, New Jersey Herald, Newton, New Jersey, Nov. 18, 2001.
"Holiday Lighting: Latest Technology Saves Time, Money and More," Fort Bend Star, Sugar Land, Texas, Nov. 21, 2001.
"Holiday Lighting: Latest Technology Saves Time, Money and More," North American Clipping Bureau, Mountain Home News, Mountain Home, Indiana, Nov. 7, 2001.
"Holiday Lighting: Latest technology saves time, money and much more," Cowboy State Press Clipping, Manderson, Wyoming, Nov. 21, 2001.
"Holiday Lighting: Latest Technology Saves Time, Money and More," Free Press, Tampa, Florida, Nov. 10, 2001.
"Holiday Lighting: Latest Technology Saves Time, Money and More," North American Clipping Bureau, Suburban News, Lexington, Alabama, Nov. 28, 2001; Indiana Weekender, Indianapolis, Indiana, Nov. 13, 2001.
"Here's a new kind of holiday lighting," Oviedo Voice, Oct. 25, 2001.
"Holiday lighting: Latest technology saves time, money and more," Luce Press Clippings, Mountain Citizen, Inez, Kentucky, Nov. 7, 2001.
"Latest holiday lighting technology saves time, money and more," North American Clipping Bureau, Southeast News Leader, Savannah, Georgia, Nov. 1, 2001.
"Holiday Lighting: Latest Technology Saves Time, Money and More," North American Clipping Bureau, Salem Observer, Salem, New Hampshire, Nov. 1, 2001.
"Holiday Lighting: Latest Technology Saves Time, Money and More," North American Clipping Bureau, Carolina Weekly Shopper, Smithfield, North Carolina, Nov. 15, 2001; Burrelle's, Hearne Democrat, Hearne, Texas, Oct. 11, 2001.
"Holiday Lighting: Latest Technology Saves Time, Money and More," North American Clipping Bureau, Chattanooga Shopper, Cookeville, Tennessee, Nov. 2, 2001.
"Holiday Lighting: Latest Technology Saves Time, Money and More," North American Clipping Bureau, Bear Facts of Maine, Norway, Maine, Nov. 19, 2001.
"Holiday Lighting: Latest Technology Saves Time, Money and More," Luce Press Clippings, Royal Centre Record, Royal Centre, Indiana, Nov. 1, 2001; Rockdale Citizen, Conyers, Georgia, Oct. 27, 2001.
U.S. Appl. No. 09/339,616; Inventor: Tuyet Thi Vo; abandoned.
U.S. Appl. No. 09/378,631, Inventor: Tuyet Thi Vo; abandoned.

* cited by examiner

BYPASS COMPONENTS IN SERIES WIRED LED LIGHT STRINGS

CROSS REFERENCE TO RELATED APPLICATIONS

This application is a continuation-in-part of U.S. patent application Ser. No. 11/461,293 entitled "Parallel Series LED Light String," by Jing Jing Yu, filed Jul. 31, 2006, and based upon U.S. Provisional Patent Application Ser. No. 60/949,804, entitled "Watertight LED Lamp," by Jing Jing Yu, filed Jul. 13, 2007. The entire contents of the above mentioned applications are hereby specifically incorporated herein by reference for all they disclose and teach.

BACKGROUND

Light emitting diodes (LEDs) have been widely used as decorative lighting sources because of their physical properties, such as low power consumption, small size and extended lifetime. The market for decorative LED light strings is large.

Currently, most of the conventional LED light strings use a serial structure such as illustrated in FIG. 1 in which of the LEDs 102, 104, 106, 108, 110, 112 are connected in series as shown in the series wired LED string 100 of FIG. 1. The series wired LED string 100 comprises a circuit having an input 114 and output 116. There are three wires that span the length of the string in the circuit of FIG. 1. This structure is also disclosed in U.S. Pat. Nos. 6,461,019 and 6,830,358 which are specifically incorporated herein by reference for all that they disclose and teach. A problem encountered with the series wired LED string 100 is that if a single LED in the string fails because the LED burns out, becomes unplugged or any other reason that may cause an open circuit, the entire string will fail. In other words, a single failure of a LED in the series wired LED circuit 100 illustrated in FIG. 1 will cause the entire string to fail and not illuminate.

To overcome the disadvantages of the series wired LED structure 100 illustrated in FIG. 1, a parallel-series wired LED string 200 has been used which is disclosed in U.S. Pat. No. 7,045,965, which is specifically incorporated herein by reference for all that it discloses and teaches. As shown in FIG. 2, the circuit has an input 216 and output 218 that includes an upper conductive pair 220 and a lower conductive pair 214. The upper conductive pair includes a wire 202 and a wire 204. The parallel-series wired LED string 200 illustrated in FIG. 2 increases the reliability of the light string 200 in comparison light string 100 of FIG. 1. As shown in FIG. 2, wires 202, 204 are connected in parallel to form two parallel-series strings. Interconnecting wires such as interconnecting wires 210, 212 create individual modules such as the parallel connected modules containing LEDs 206, 208. If one of the LEDs 206, 208 fails, the other LED continues to provide a conductive path in the upper conductive pair 220. For example, if LED 206 fails and creates an open circuit, the conductive path continues through LED 208 in the upper conductive pair 220.

A disadvantage with respect to the circuit illustrated in FIG. 2 is that there are four wires that span the length of the string in the circuit of FIG. 2. Since the cost of the wires is the dominant cost for LED light strings, the competitiveness of the parallel-series wired LED string 200 of FIG. 2 is diminished. Also, if both LEDs in a module burn out or otherwise create an open circuit, the entire string will not illuminate.

SUMMARY OF THE INVENTION

An embodiment of the present invention may therefore comprise twinkle LED lamp that can be used in a series wired LED light string comprising: a twinkle LED element; a first lead connected to an input of the twinkle LED element; a second lead connected to an output of the twinkle LED element; a bypass component connected to the first lead and to the second lead; a lamp proxy that encapsulates the twinkle LED element and the bypass component.

An embodiment of the present invention may further comprise a twinkle LED lamp that can be used in a series wired LED light string comprising: a twinkle LED element; a first lead connected to an input of the twinkle LED element; a second lead connected to an output of the twinkle LED element; a lamp proxy that encapsulates the twinkle LED element; a bypass component connected to the first lead and to the second lead outside of the lamp proxy.

An embodiment of the present invention may further comprise an LED lamp that can be used in a series wired LED light string comprising: an LED element; a first lead connected to an input of the LED element; a second lead connected to an output of the LED element; a bypass component connected to the first lead and to the second lead; a lamp proxy that encapsulates the LED element and the bypass component.

An embodiment of the present invention may further comprise an LED lamp that can be used in a series wired LED light string comprising: an LED element; a first lead connected to an input of the LED element; a second lead connected to an output of the LED element; a lamp proxy that encapsulates the LED element and the bypass component; a bypass component connected to the first lead and to the second lead outside of said lamp proxy.

An embodiment of the present invention may further comprise a lamp holder for an LED lamp that is connected in a series wired LED light string and that allows the series wired LED light string to operate with twinkle LED lamps, burned out standard LED lamps and improperly connected LED lamps comprising: a pair of contact sockets that releasably connect to the standard LED lamps and the twinkle LED lamps; a pair of power leads connected to the contact sockets, the pair of power leads connected in series in the series wired LED light string; a bypass component connected between the pair of contact sockets that places the bypass component in parallel with the LED lamps that are releasably connected to the contact sockets; a plastic housing that is molded around and encapsulates the pair of contact sockets, the pair of power leads and the bypass component and that holds the pair of contact sockets, the pair of power leads and the bypass component in a sealed, stable structure to provide the lamp holder.

An embodiment of the present invention may further comprise a method of manufacturing an LED lamp for use in a series wired LED light string comprising: providing an LED element; connecting a first lead to an input of the LED element; connecting a second lead to an output of the LED element; connecting a bypass component to the first lead and the second lead; encapsulating the LED element and the bypass component in a lamp proxy.

An embodiment of the present invention may further comprise a method of manufacturing an LED lamp for use in a series wired LED light string comprising: providing an LED element; connecting a first lead to an input of the LED element; connecting a second lead to an output of the LED element; encapsulating the LED element and a bypass component in a lamp proxy; connecting the bypass component to the first lead and the second lead outside of the lamp proxy.

An embodiment of the present invention may further comprise a method of manufacturing a lamp holder for use in a series wired LED light string comprising: providing a pair of contact sockets that releasably connect to LED lamps; connecting a pair of power leads to the contact sockets so that the contact sockets are connected in series in the series wired LED light string; connecting a bypass component between the pair of contact sockets that places the bypass component in parallel with the LED lamps that are releasably connected to the contact sockets; encapsulating the pair of contact sockets, the pair of power leads and the bypass component in a molded plastic housing that holds the pair of contact sockets, the pair of power leads and the bypass component in a sealed, stable structure.

DETAILED DESCRIPTION OF THE EMBODIMENTS

Figure 3:
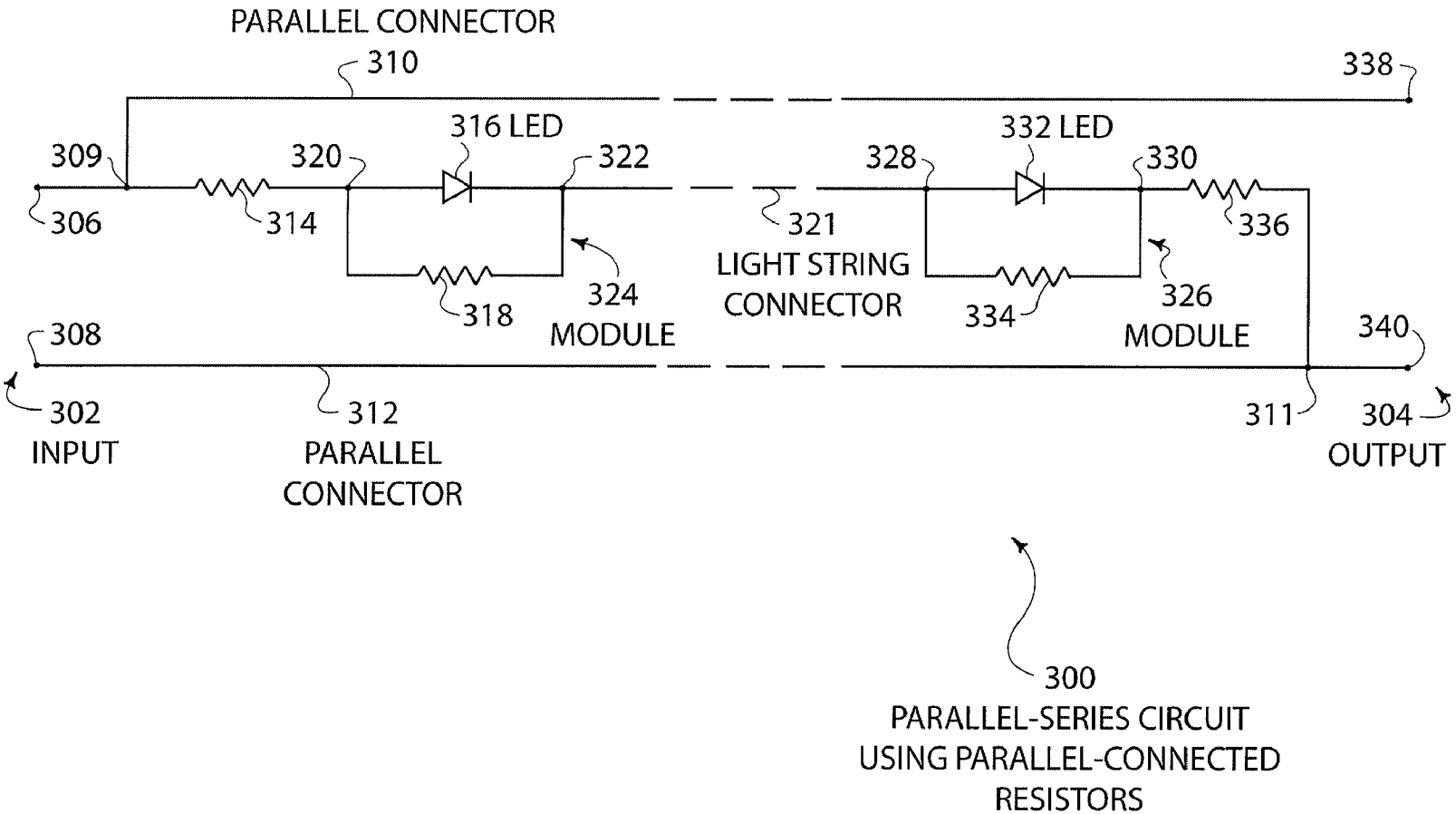
FIG. 3 is a schematic circuit diagram of an embodiment of a parallel-series circuit using parallel connected resistors.

FIG. 3 is a schematic circuit diagram of an embodiment of a parallel-series circuit 300 using parallel connected resistors. Circuit 300 has an input 302 at nodes 306, 308 and an output 304 at nodes 338, 340. The parallel connector 310 includes a series of circuit elements. Resistors 314 and 336 are inserted in series in the connector 310 to limit the operating voltages of the LEDs that are connected in series in connector 310. Only one resistor is required for this purpose, although two resistors are shown. In addition, a plurality of modules, such as modules 324, 326, are connected in series in connector 310. Each module contains a LED and a resistor connected in parallel. For example, module 324 includes a LED 316 which is connected in parallel with a resistor 318. Similarly, module 326 includes a LED 332 that is connected in parallel with a resistor 334.

The parallel connected LED and resistors of each of the modules are packaged together in the lamp holder, such as a lamp socket, during manufacture. In this fashion, the cost of an additional wire is eliminated, thereby substantially reducing the cost of the parallel-series circuit 300, illustrated in FIG. 3. For example, the resistor 318 is connected directly across the LED 316 at nodes 320, 322 that are inside the lamp socket. The direct connection within the lamp socket simplifies the system and minimizes the material cost. Each of the modules included in the light string thereby constitutes a LED with a resistor embedded in the lamp holder that is connected across the terminals of the LED. The resistor can comprise a discrete component or otherwise be included as an integral part of the wiring of the LED lamp holder, such as a resistive wire or other element having resistive characteristics. The resistors can be molded into the plastic holder, if desired, during manufacture or later inserted in the lamp holder and connected to the connector leads in the lamp holder. In addition, the resistors can be pre-wired prior to insertion in the lamp holders.

Figure 1:
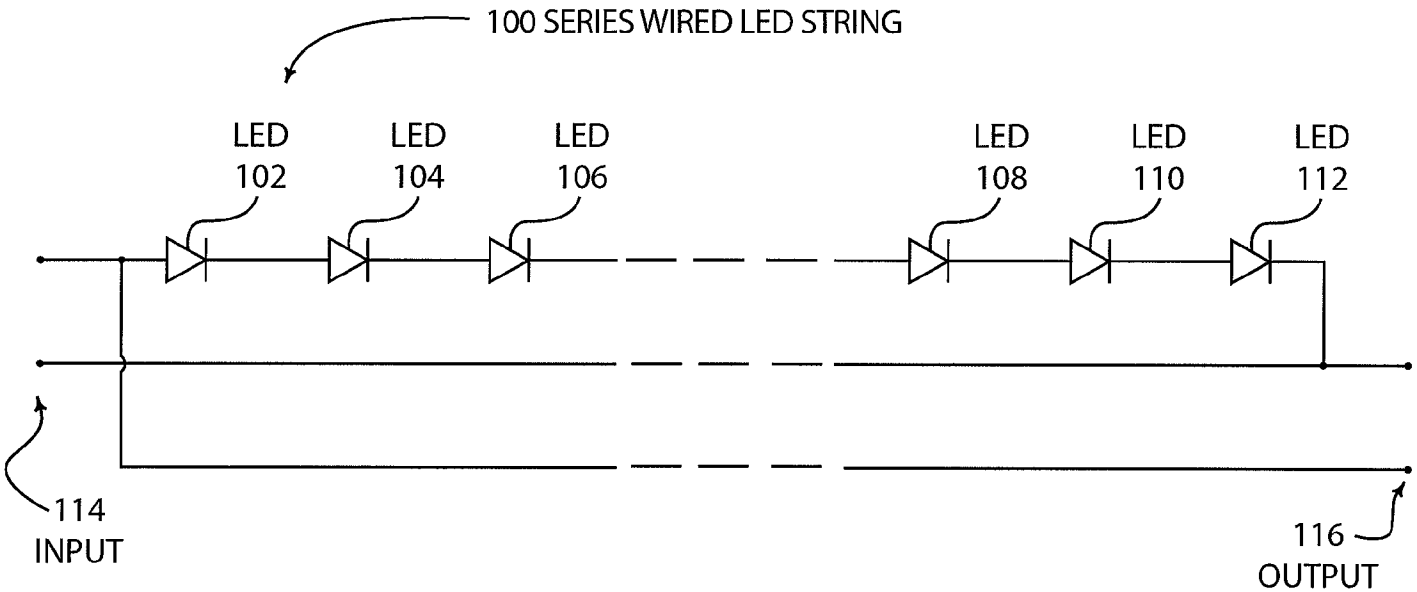
FIG. 1 (PRIOR ART)
FIG. 1 is a schematic circuit diagram of a series connected LED string.
Figure 2:
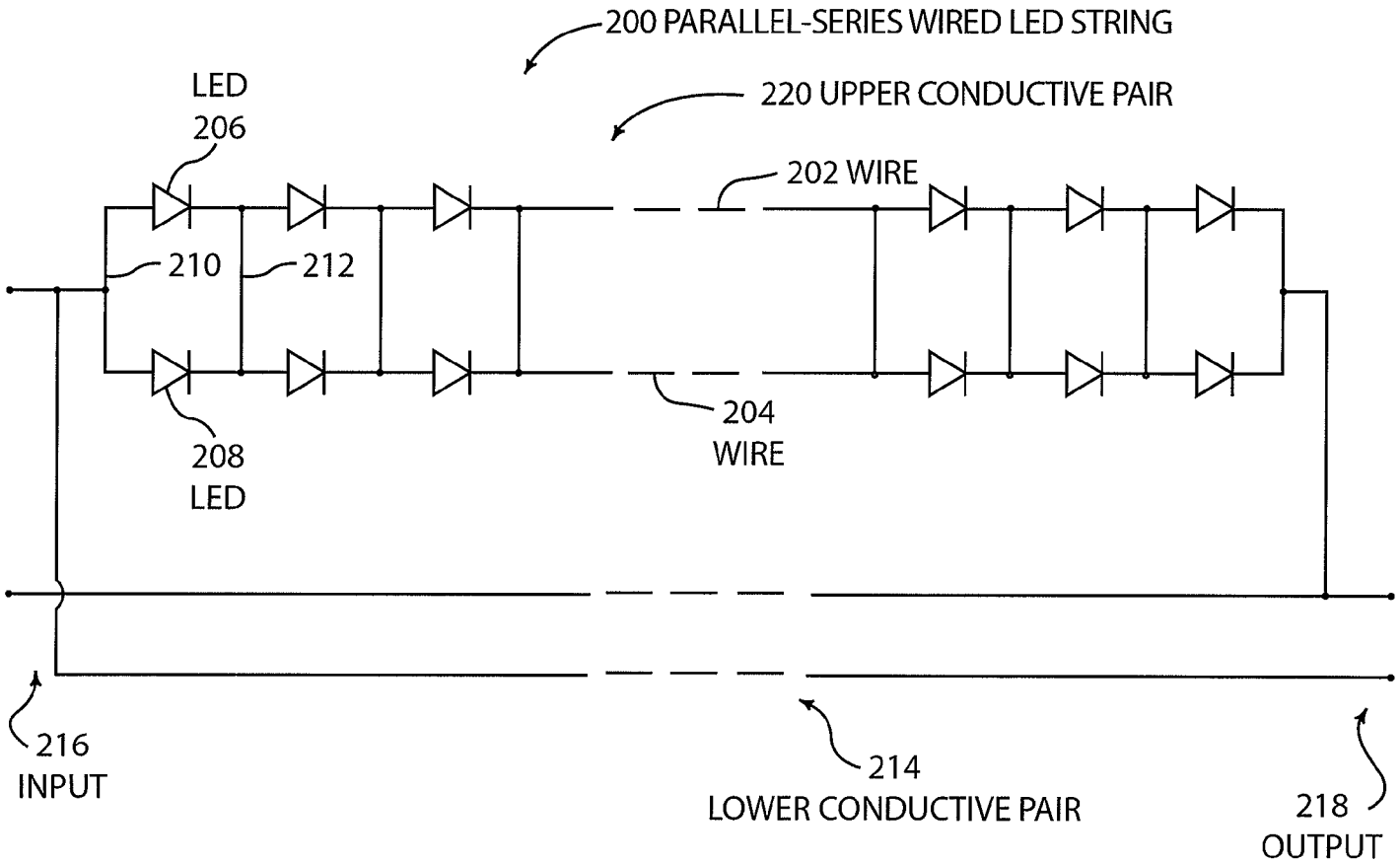
FIG. 2 (PRIOR ART)
FIG. 2 is a schematic circuit diagram of a parallel-series wired LED string.

As shown in FIG. 3, a plurality of these modules are connected in series in the light string connector 321 for each light string, such as illustrated in FIG. 3. The light string connector 321 is connected at node 309 to parallel connector 310 near the input 302. The light string connector 321 is connected at node 311 to parallel connector 312 near the output 304. In this manner, the light string connector 321 essentially spans the length between the input 302 and the output 304 so that the modules are displaced along the length of the parallel-series circuit 300. As indicated above, if any of the LEDs in the light string, such as LEDs 316, 332 go out, the continuity in light string connector 321 is maintained by the parallel connected resistors. When comparing the embodiment of FIG. 3 to the embodiment of FIG. 2, the embodiment of FIG. 2 has an additional wire spanning the length of the light string, plus the additional cost of the interconnecting wires, such as wires 210, 212. The embodiment of FIG. 3 has the advantage of providing the reliability of the circuit of FIG. 2, without the cost of an additional wire. Further, if one of the LEDs of the embodiment of FIG. 3 goes out, not only is the continuity of the light string connector 321 maintained, but in addition, the parallel connected resistors, such as parallel connected resistors 318, 334, further enhances the reliability of the embodiment circuit of FIG. 3 over the circuit of FIG. 2, since the parallel connected resistors are much less likely to burn out than the parallel connected LEDs of FIG. 2. If the LEDs, such as LEDs 316, 332 are replaceable in a socket, the LEDs that burn out can be readily identified and new ones can simply be plugged into the socket without affecting the overall operation of the circuit 300. If one of the LEDs 316, 332 of FIG. 3 is shorted, that particular module will become shorted. Series connected resistors 314, 336 limit the current sufficiently that an overload condition does not occur on light string connector 321 even if several modules are shorted. Hence, series connected resistors 314, 336 are sized to accommodate the shorting of one, several, or all of the LEDs, such as LEDs 316, 332.

Figure 4:
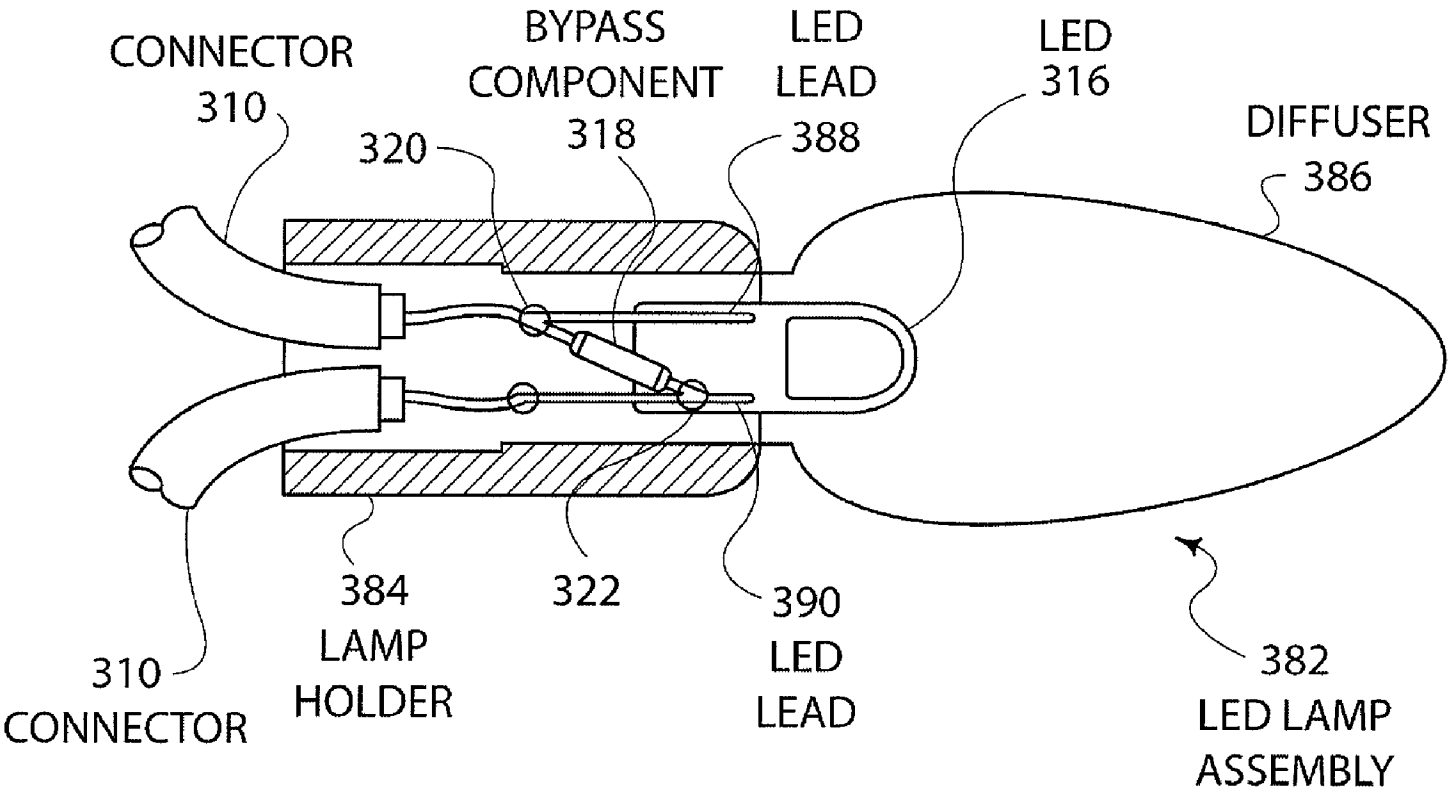
FIG. 4 is a schematic illustration of the manner in which a parallel connected resistor can be incorporated in a LED lamp holder.

FIG. 4 is a schematic illustration of a LED lamp assembly 382 that corresponds to the module 324 of FIG. 3. As shown in FIG. 4, the LED 316 is housed within a diffuser 386 that diffuses the light emitted by the LED 316. The LED 316 is disposed within the lamp holder 384 which may be made of a plastic material. Connector 310 is disposed within another opening in the lamp holder 384 and is connected at nodes 320, 322 to the leads 388, 390 of the LED 316. The bypass component 318 is also connected across the leads 388, 390 of the LED 316 at nodes 338, 340 to place the bypass component 318 in parallel with the leads of LED 316. The bypass component 318 can comprise a resistor or diode, as described below. In this manner, the reliability of the light string can be greatly enhanced without substantially increasing the cost over a standard series connected light string.

Figure 5:
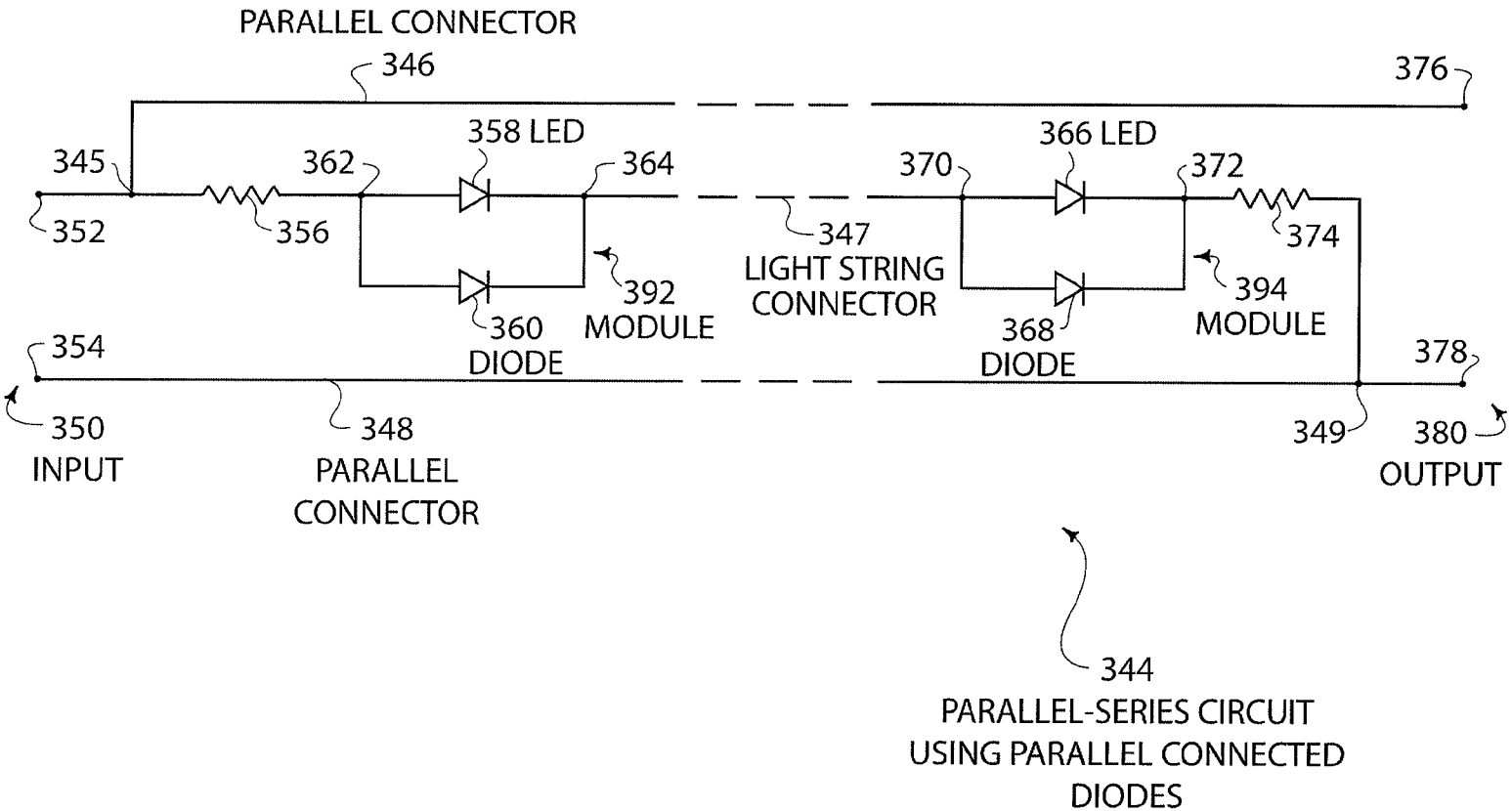
FIG. 5 is a schematic circuit diagram of another embodiment of a parallel-series circuit using parallel connected diodes.

FIG. 5 is an illustration of another embodiment. FIG. 5 illustrates a parallel-series connected circuit 344 that uses parallel connected diodes. The circuit 344 includes an input 350 having nodes 352, 354. The input nodes 352, 354 are connected to parallel connector 346 and parallel connector 348. Parallel connector 346 is also connected to an output 380 at node 376. Parallel connector 348 is connected to the output 380 at node 378. Light string connector 347 is connected to the parallel connector 346 at node 345 which is proximate to the input 350. In addition, light string connector 347 is connected to parallel connector 348 at node 349 which is proximate to the output 380. In this fashion, the light string connector 347 essentially spans the length of the parallel-series circuit 344. Input 350 may comprise a plug for plugging the circuit 344 into a 117 volt RMS AC current source. The output nodes 376, 378 may be connected to a socket so that additional light strings may be connected in series with the light string circuit 344 illustrated in FIG. 5.

As shown in FIG. 5, resistors 356, 374 are connected in series in the light string connector 347 to limit the current flowing through the light string connector 347. Although parallel connector 346 includes two resistors 356, 374, a single resistor can be used in place of two resistors. In addition, a plurality of modules, such as modules 392, 394, are connected in series in the light string connector 347. Each of these modules includes a parallel connected LED and diode. For example, module 392 includes a LED 358 that is connected in parallel with a diode 360. The LED 358 is held in a lamp holder, such as a plastic lamp holder 384, illustrated in FIG. 4. Diode 360 can be connected across the leads of the LED 358, in the same manner as resistor 318 is connected across the leads of LED 316 illustrated in FIG. 4 and can be disposed in the lamp holder. The connection of diode 360 across the leads of the LED 358 at nodes 362, 364 reduces the material cost of the circuit 344 and greatly increases the reliability of the circuit 344. Diode 360 has a forward breakdown voltage that is higher than the LED 358 so that the LED 358 is not shorted out by the diode 360. Hence, the current flowing through light string connector 347 preferentially travels through the LED 358 which has a lower breakdown voltage than diode 360. Similarly, module 394 has a diode 368 that is connected across the leads of LED 366 at nodes 370, 372. Diode 368 also has a higher breakdown voltage than LED 366 so that current preferentially flows through LED 366. Of course, if LED 358 burns out and creates an open circuit, current will flow through diode 360 since the forward breakdown voltage will be exceeded.

Figure 6:
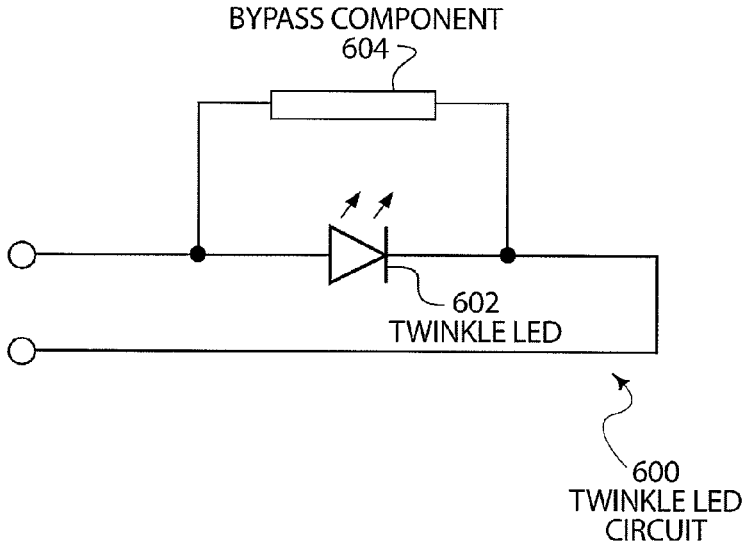
FIG. 6 is a schematic diagram of a twinkle circuit that has a bypass component connected in parallel.

FIG. 6 is a schematic diagram of a twinkle circuit 600. As shown in FIG. 6, a twinkle LED 602 is connected in parallel with a bypass component 604. Twinkle light emitting diode elements produce flashing and changing color effects by changing the current that passes through the twinkle LED. For example, twinkle LEDs may randomly switch the current on and off that passes through the twinkle LED. As a result, a series connected twinkle LED would normally intermittently block the current flow in a series connected string of LEDs. For this reason, twinkle LEDs are not able to be connected in series in a serial LED string because of the interference that each of the twinkle LEDs would cause to the other LEDs in the string, whether these LEDs are twinkle LEDs or regular LEDs. Hence, inserting twinkle LEDs into a normal light string, or mixing twinkle LEDs with other normal LEDs in a series connected light string would not work. By installing a bypass component 604, such as a resistor, or a diode having a forward breakdown voltage that is higher than the twinkle LED 602, twinkle LEDs can be used in a series connected circuit without interfering with other devices, since current will flow through the bypass component when the twinkle LED element blocks the flow of current.

Figure 7:
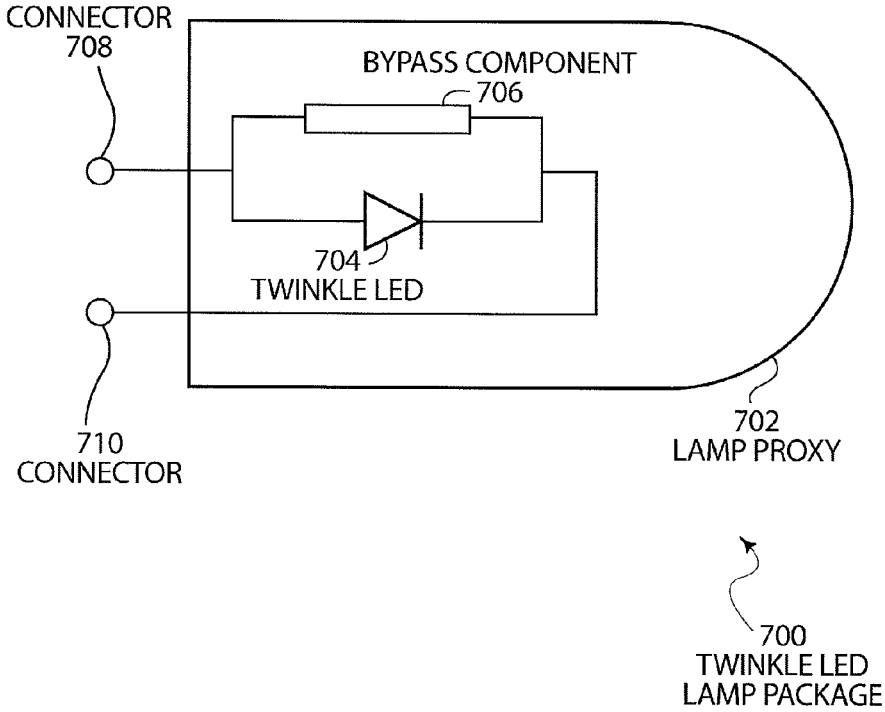
FIG. 7 is a schematic illustration of a twinkle LED lamp package having a bypass component connected in parallel.

FIG. 7 is a schematic illustration of a twinkle LED lamp package 700 that incorporates a twinkle LED 704 and a bypass component 706 that is packaged in a lamp proxy 702. Again, the bypass component can comprise a small resistive element, a diode having a forward breakdown voltage that is greater than the forward breakdown voltage of the twinkle LED 704, or other similar bypass component, that allows current to flow between connector 708 and connector 710, when the twinkle LED 704 interrupts the flow of current in the twinkle LED lamp package 700. In other words, when the twinkle LED 704 interrupts the current flow from connector 708 to connector 710, the current then flows through the bypass component 706 so that the current is not interrupted between connector 708 and connector 710. Connector 708, 710 can comprise plug-in connectors that are capable of plugging into sockets on a lamp holder, as disclosed below, or can be hard wired to the LED lighting string.

Figure 8:
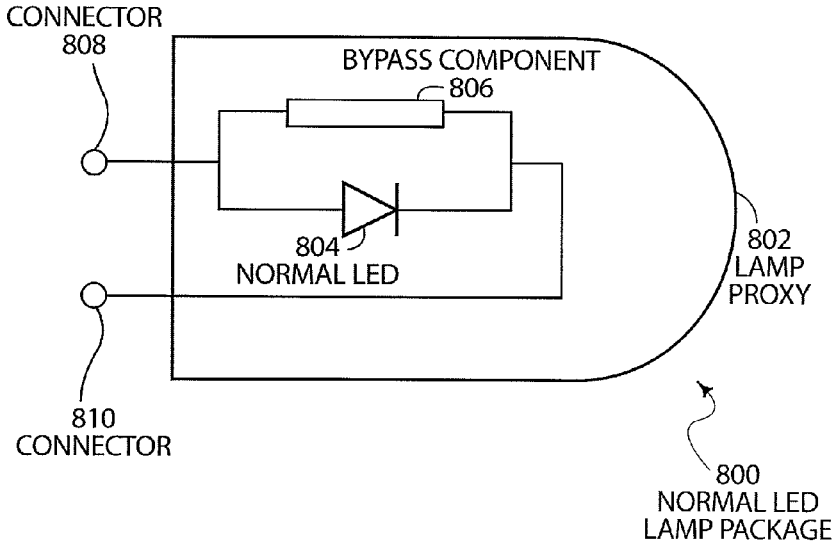
FIG. 8 is a schematic diagram of a standard LED element with a bypass component connected in parallel.

FIG. 8 is a schematic diagram of a standard LED lamp package 800. As shown in FIG. 8, the standard LED lamp package 800 includes a standard LED 804, a bypass component 806 that is connected in parallel to the normal LED 804. The standard LED 804 and the bypass component 806 are packaged within the lamp proxy 802. Again, the bypass component 806 can comprise a resistor, a diode, as described above, or other suitable bypass component. Connectors 808 and 810 may comprise plug-in leads that can plug into a socket in a lamp holder, or can be hard-wired to the LED lighting string. The bypass component 806 allows the current to pass through the standard LED lamp package 800 from connector 808 to connector 810 when the standard LED 804 burns out.

Figure 9:
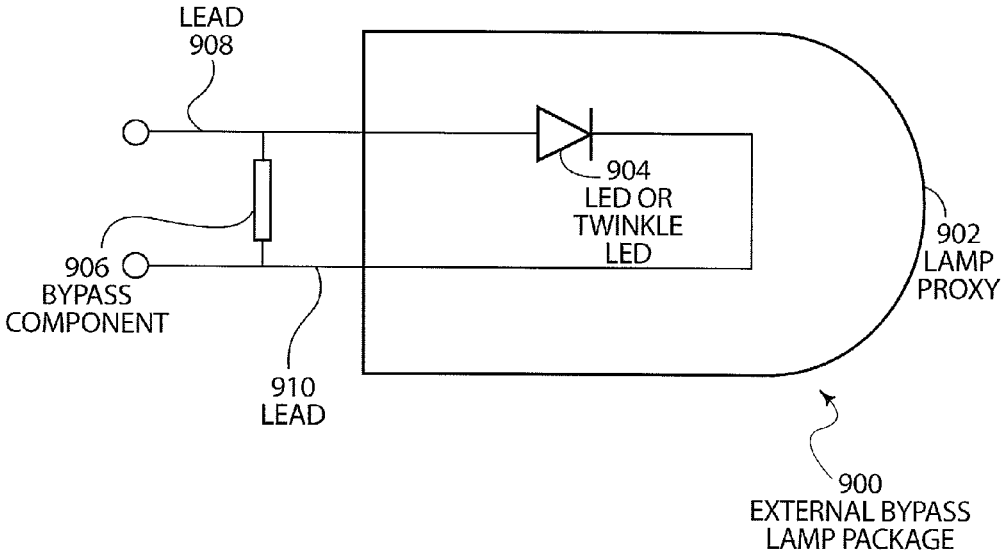
FIG. 9 is a schematic illustration of an external bypass lamp package.

FIG. 9 is a schematic illustration of an external bypass lamp package 900. As shown in FIG. 9, either an LED or a twinkle LED 904 can be enclosed within the lamp proxy 902. A bypass component 906 can be connected between the leads 908, 910 external to the lamp proxy 902. In this fashion, the bypass component 906 is not sealed within the lamp proxy 902 and can be attached between the leads 908, 910 after the assembly of the lamp proxy 902. In this manner, existing LED lamps can be retrofitted to include a bypass component 906. In addition, in some embodiments, it may be advantages to include the bypass component 906 external to the lamp proxy 902 for various reasons, including, but not limited to, the fact that the bypass component 906 may affect the optical characteristics of the lamp proxy 902.

Figure 10:
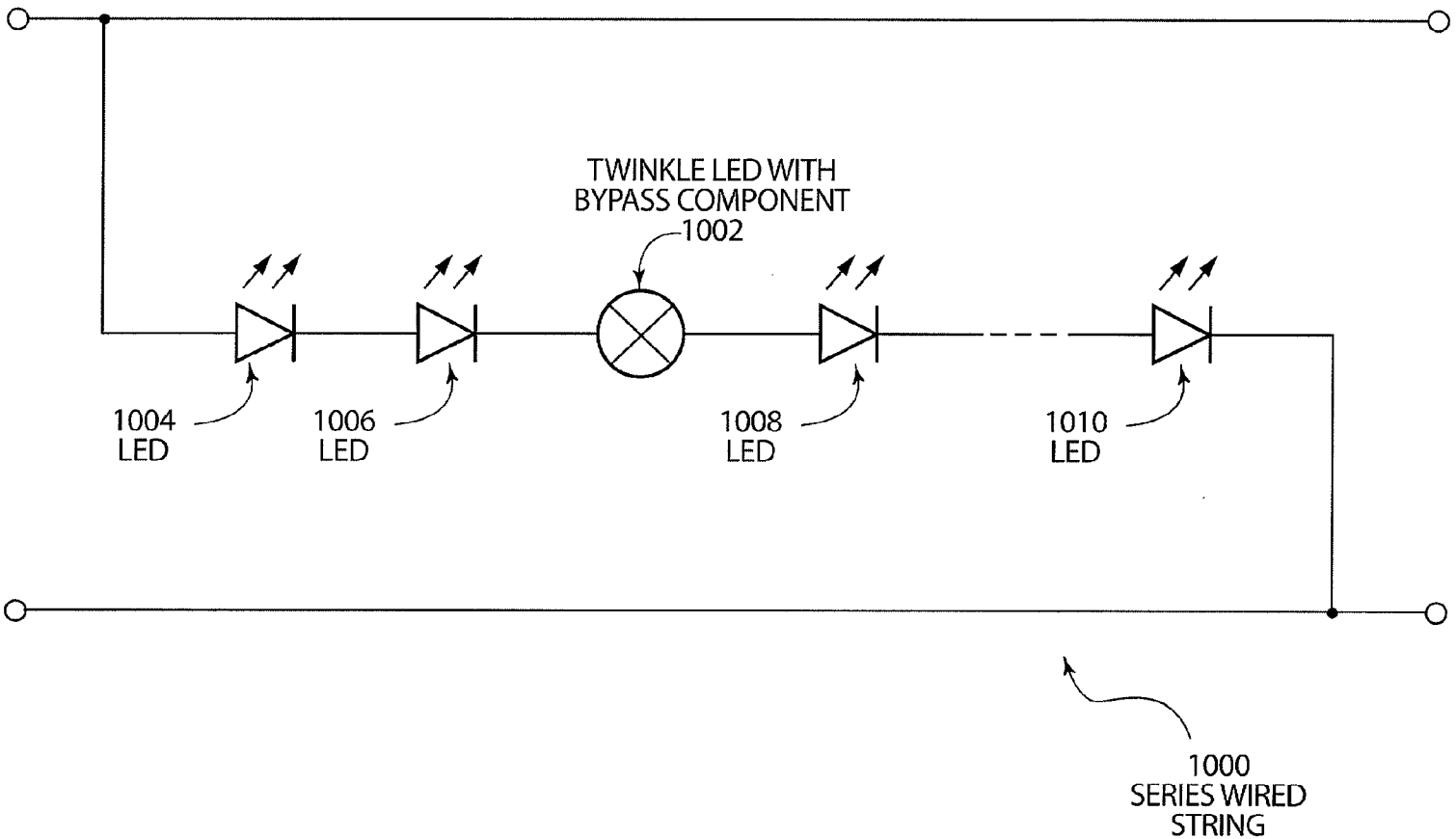
FIG. 10 is a schematic illustration of a series wired string that includes a twinkle LED element with a bypass component.

FIG. 10 discloses a series wired string 1000 that includes a twinkle LED element with a bypass component (bypass twinkle LED) 1002 that is included in the string. As shown in FIG. 10, the series wired LED string 1000 has a series of standard LEDs 104, 106, 108, 110. In some instances, if one of the standard LEDs in the series wired LED string 1000 burns out, the user may wish to replace the burned out LED with a bypass twinkle LED 1002. Similarly, the user may wish to enhance a standard series wired LED string, such as LED string 1000, with a twinkle LED, but would not otherwise be able to do so, since a standard twinkle LED will shut down the entire series wired string. As illustrated in FIG. 10, a standard series wired LED string can be enhanced with a bypass twinkle LED, such as bypass twinkle LED 1002, without affecting the operation of the series wired LED string 1000, since the bypass component of the bypass twinkle LED 1002 allows current to continue to flow through the series wired LED string 1000, even when the flow of current is blocked through the twinkle LED element, as disclosed above. Hence, standard series wired LED strings can be enhanced with twinkle LEDs either by a manufacturer or user in a simple and easy manner.

Figure 11:
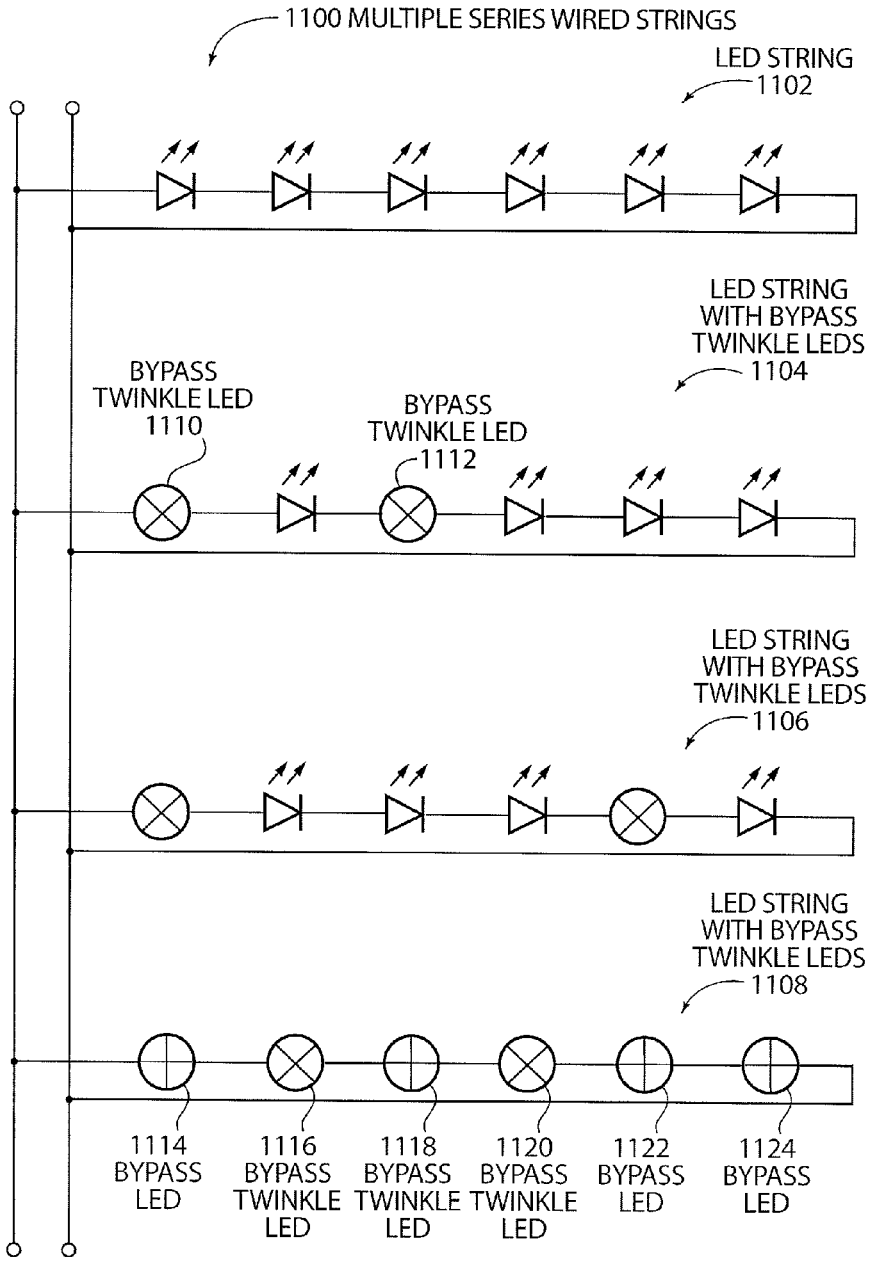
FIG. 11 is a schematic diagram of multiple series wired strings.

FIG. 11 is a schematic diagram of multiple series wired strings 1100. As shown in FIG. 11, the multiple strings of series wired LEDs include LED string 1102, LED string with bypass twinkle LEDs 1104, LED string with bypass twinkle LEDs 1106, and LED string with bypass twinkle LEDs and bypass LEDs 1108. LED string 1102 comprises a series of standard LEDs wired in series that do not include any twinkle LEDs or bypass components. LED string 1102 is a typical inexpensive series wired LED light string. LED string 1104 includes bypass twinkle LEDs 1110, 1112, such as illustrated in FIGS. 6, 7 and 9. Bypass twinkle LEDs 1110, 1112 may be inserted by the manufacturer or a user into the series wired string and provide an enhanced twinkle LED to the LED string 1104, without affecting the operation of the series wired light string. LED string 1106 also includes bypass twinkle LEDs in different locations on the LED string 1106. LED string 1108 includes bypass twinkle LEDs 1116, 1120 and also includes bypass LEDs 1114, 1118, 1122 and 1124, such as illustrated in FIG. 8. The advantage of the light string 1108 over the light strings 1102, 1104 and 1106 is that if any of the LED components in light string 1108 burn out, the series wired light string 1108 will not stop operating, since each of the LEDs in the light string 1108 has a bypass component.

Figure 12:
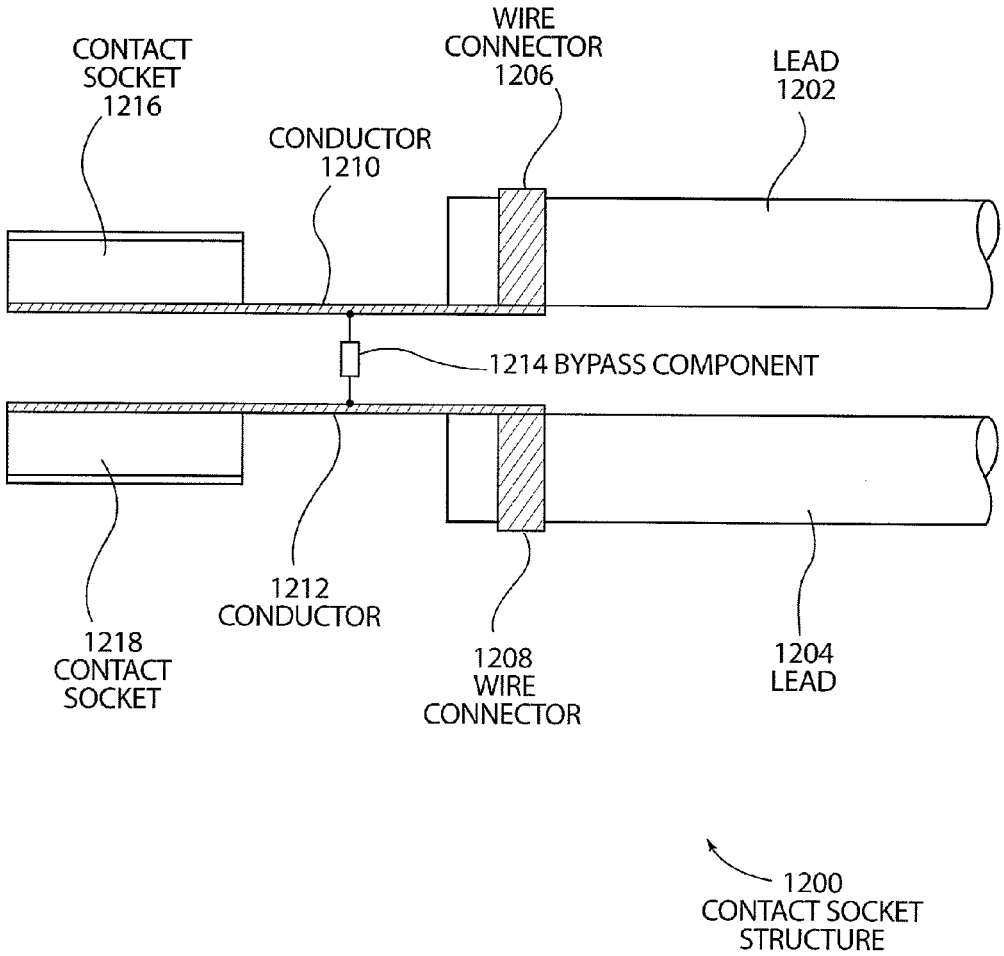
FIG. 12 is a schematic diagram of a contact socket structure.

FIG. 12 is a schematic illustration of a contact socket structure 1200 that may be disposed in a lamp holder. The contact socket structure and associated housing and other components are more fully disclosed in U.S. Patent Application Ser. No. 60/949,804, entitled "Watertight LED Lamp," filed Jul. 13, 2007, by Jing Jing Yu, which is specifically incorporated herein by reference for all that it discloses and teaches. The contact socket structure 1200 includes contact sockets 1216, 1218 that are conductively connected to conductors 1210, 1212, which are in turn conductively connected to wire connectors 1206, 1208, respectively. Wire connectors 1206, 1208 conductively connect to leads 1202, 1204, so as to conductively connect the contact sockets 1216, 1218 to leads 1202, 1204, respectively. A bypass component 1214 is connected between the conductors 1210, 1212. The bypass component can be connected anywhere along the conductors 1210, 1212, or to the wire connectors 1206, 1208, or even between the contact sockets 1216, 128. Again, the bypass component 1214 can comprise a resistive component, such as a resistor, a diode having a forward breakdown voltage that is higher than the forward breakdown voltage of the LED element in LED lamp 1304 (FIG. 13), or other suitable bypass component. The bypass component 1214, for example, may comprise a resistive wire that has a resistance that is sufficient to cause current to flow preferentially through the LED element, while also allowing current to flow through the bypass component without creating an undue amount of heat in the lamp holder whenever the LED element is burned out or improperly connected.

Figure 13:
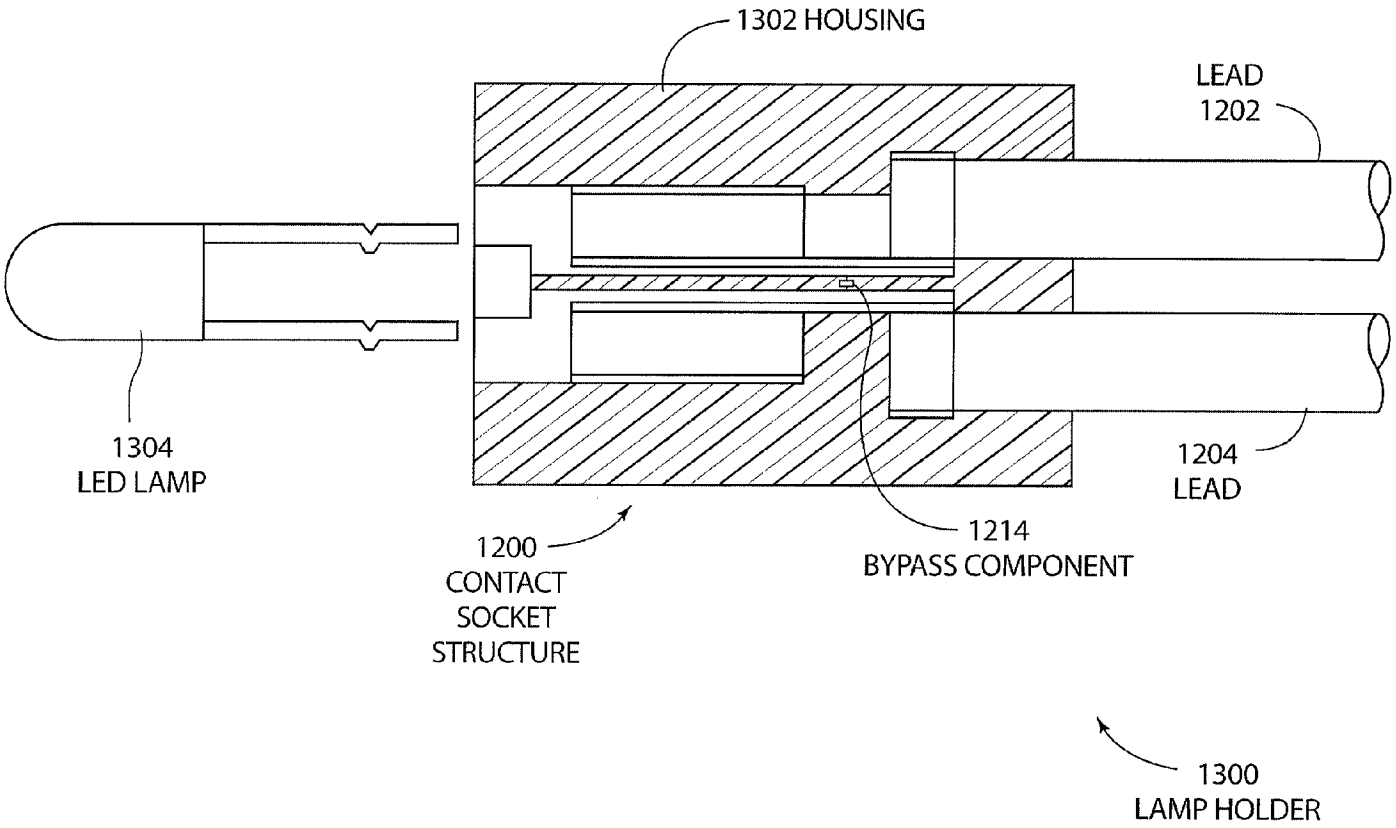
FIG. 13 is a schematic cutaway illustration of a lamp holder.

FIG. 13 is a schematic cutaway illustration of a lamp holder 13. As shown in FIG. 13, the lamp holder includes a housing 1302 that encapsulates the contact socket structure 1200 and the power leads 1202, 1204. In addition, the bypass component 1214 is also encapsulated in the plastic housing material. The plastic housing material holds the contact socket structure 1200, as well as the bypass component 1214, in a sealed, stable structure, so that the LED lamp 1304 can be plugged in and removed from the contact socket structure 1200. By providing the bypass component 1214 in the structure of the housing 1302, standard LED lamps or twinkle LED lamps can be used with the lamp holder 1300 without affecting a series wired LED light string. The advantage of using the embodiments of FIGS. 12 and 13 is that if the LED lamp 1304 becomes disconnected for any reason, the bypass component is disposed in the housing 1302 so that the operation of the LED string will not be affected. For example, if the LED lamp 1304 does not have a proper contact to the contact socket structure 1200, or if the LED lamp 1304 falls out of the housing 1302, or otherwise is not connected for any reason, the series wired string will continue to operate, since the bypass component 1214 is disposed in the housing 1302.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A series wired LED lighting system comprising:

a twinkle LED lamp comprising:

a twinkle LED element;

a first twinkle lead connected to an input of said twinkle element;

a second twinkle lead connected to an output of said twinkle element;

a first bypass component connected to said first twinkle lead and said second twinkle LED lead so that said first bypass component is connected in parallel to said twinkle LED element;

a first lamp proxy that encapsulates said twinkle LED element and said first bypass component;

an LED lamp comprising:

an LED element;

a first lead connected to an input of said LED element;

a second lead connected to an output of said LED element;

a second bypass component connected to said first lead and said second lead of said LED element so that said second bypass component is connected in parallel to said LED element;

a second lamp proxy that encapsulates said LED element and said second bypass component;

a first lampholder comprising:

a first pair of contact sockets that releasably connect to said first twinkle lead and said second twinkle lead of said twinkle element so that said twinkle LED lamp is replaceable in said first lampholder;

a first pair of power leads connected to said first pair of contact sockets;

a first plastic housing that is molded around and encapsulates said first pair of contact sockets and said first pair of power leads, said first plastic housing securing said first pair of contact sockets and said first pair of power leads in a sealed, stable structure;

a second lampholder comprising:

a second pair of contact sockets that releasably connect to said first LED lead and said second LED lead of said LED element so that said LED lamp is replaceable in said second lampholder;

a second pair of power leads connected to said second pair of contact sockets;

a second plastic housing that is molded around and encapsulates said second pair of contact sockets and said second pair of power leads, said second plastic housing securing said second pair of contact sockets and said second pair of power leads in a sealed stable structure.

2. The light system of claim 1 wherein said first bypass component comprises a diode having a forward breakdown voltage that is greater than a forward breakdown voltage of said twinkle LED element.

3. The lighting system of claim 1 wherein said second bypass component comprises a diode having a forward breakdown voltage that is greater than a forward breakdown voltage of said LED element.

4. The lighting system of claim 1 wherein said first and second bypass components comprises a resistive element.

5. The lighting system of claim 1 wherein said first and second power leads of said first and second lampholders are connected in series in a series wired LED light string of said series wired LED lighting system.

6. The lighting system of claim 1 that operates with twinkle LED lamps, burned out standard LED lamps and improperly connected lamps without shutting off other lights in said series wired LED lighting string.

7. A method of manufacturing a series wired LED lighting system comprising:

providing an LED element;

connecting a first LED lead to an input of said LED element;

connecting a second LED lead to an output of said LED element;

providing a twinkle LED element;

connecting a first twinkle LED lead to an input of said twinkle LED element;

connecting a second twinkle LED lead to an output of said twinkle LED element;

connecting a first bypass component in parallel with said LED element;

connecting a second bypass component in parallel with said twinkle LED element;

encapsulating said first bypass component, said first LED lead, said second LED lead and said LED element inside a first lamp proxy;

encapsulating said second bypass component, said first twinkle LED lead, and said second twinkle LED lead and said twinkle LED element inside a second lamp proxy;

providing a lampholder having a pair of contact sockets formed to releasably connect to said first LED lead and said second LED lead, and to releasably connect to said first twinkle LED lead and said second twinkle LED lead;

connecting a pair of power leads to said contact sockets of said lampholder so that said contact sockets are connected in series in said series wired LED light string;

encapsulating said pair of contact sockets and said pair of power leads in a molded plastic housing of said lampholder that holds said pair of contact sockets and said pair of power leads in a sealed stable structure.

8. The method of claim 7 wherein said process of connecting a first bypass component comprises:

connecting a resistive wire between said first LED lead and said second LED lead.

9. The method of claim 7 wherein said process of connecting a first bypass component to said first LED lead and said second LED lead comprises:

connecting a diode having a forward breakdown voltage that is greater than a forward breakdown voltage of said LED element.

10. The method of claim 7 wherein said process of connecting a second bypass component to said first twinkle LED lead and said second twinkle LED lead of said twinkle LED element comprises:

connecting a diode having a forward breakdown voltage that is greater than a forward breakdown voltage of said twinkle LED element.

* * * * *